United States Patent [19]

Akazawa

[11] Patent Number: 4,602,882

[45] Date of Patent: Jul. 29, 1986

[54] CONTROL SYSTEM OF SERIAL PRINTER

[75] Inventor: Hiroyuki Akazawa, Shiojiri, Japan

[73] Assignee: Seiko Epson Corporation, Tokyo, Japan

[21] Appl. No.: 520,269

[22] Filed: Aug. 4, 1983

[30] Foreign Application Priority Data

Aug. 5, 1982 [JP] Japan ..... 58-136681

[51] Int. Cl.[4] ..... B41J 19/50

[52] U.S. Cl. ..... 400/322; 400/903; 318/696

[58] Field of Search ..... 400/903, 320, 322; 318/696

[56] References Cited

U.S. PATENT DOCUMENTS

| | | | |
|---|---|---|---|
| 3,909,125 | 9/1975 | Reehil et al. | 318/696 |
| 4,024,447 | 5/1977 | Epstein | 400/903 |
| 4,024,941 | 5/1977 | Sekikawa et al. | 400/903 |
| 4,145,644 | 3/1979 | Lin | 318/696 |
| 4,339,702 | 7/1982 | Araki et al. | 318/696 |
| 4,350,456 | 9/1982 | Noda | 400/322 |
| 4,443,746 | 4/1984 | Araki | 318/696 |
| 4,465,959 | 8/1984 | Yajima | 318/696 |

*Primary Examiner*—William Pieprz

*Attorney, Agent, or Firm*—Blum Kaplan Friedman Silberman & Beran

[57] ABSTRACT

A serial printer includes a control circuit for driving the printer carriage. The control circuit detects the change of level of a home position signal in synchronism with a print position signal which is produced based upon occurrence of particular data selected out of a cycle of data for driving a step motor so as to increase the permissible range of variation in the change of the level of the home position signal that takes place due to mechanical vibrations differing in mode or phase.

18 Claims, 6 Drawing Figures

FIG. 2
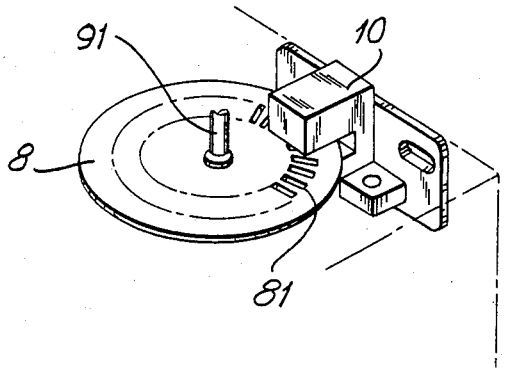
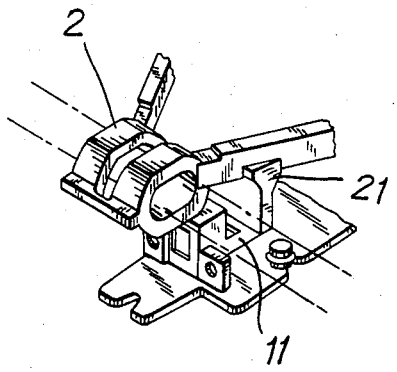
FIG. 3

FIG. 4
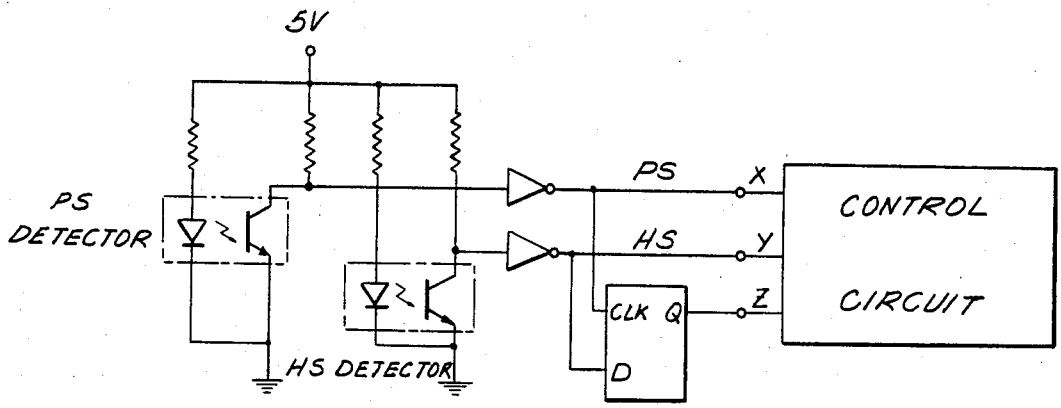
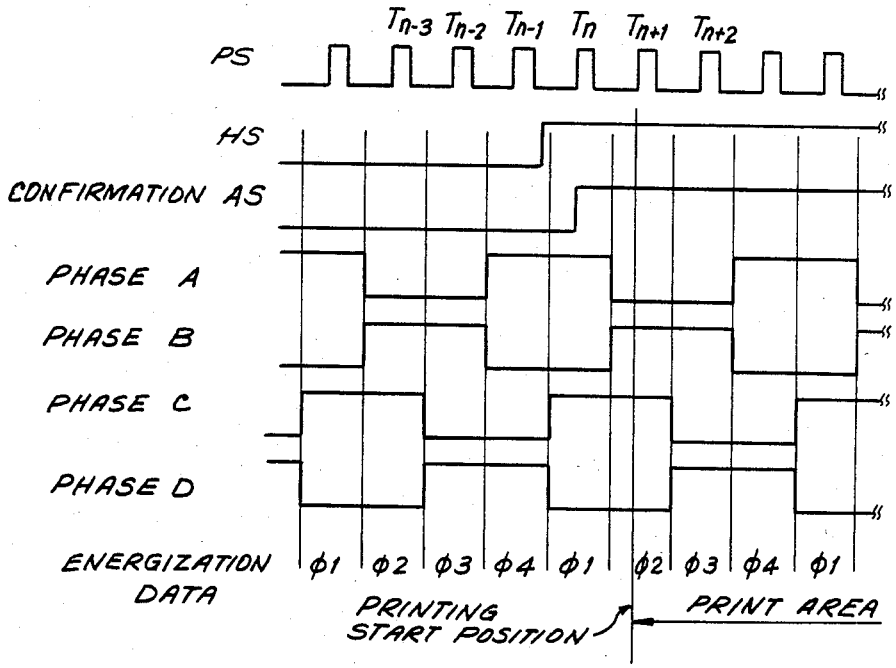
FIG. 5

CONTROL SYSTEM OF SERIAL PRINTER

BACKGROUND OF THE INVENTION

This invention relates generally to a printer of the type using a carriage translating laterally across the paper to be printed upon and more particularly to a control system for a serial printer where each line of print is begun at a uniform lateral position. In the prior art, many serial printers have been produced which use a step motor for driving a carriage. The output portion of the motor is provided with a detecting device to produce a signal indicative of the printing position for use as a timing signal when a printing head, carried on the carriage, is driven for printing. In printers of this type, the position at which printing begins is detected by ANDing the printing position signal with an output from a detecting device which allows a control circuit to detect a stand-by or home position of the carriage. In other words, coincidence between the home position signal and the print position signal is sufficient to permit the initiation of printing. However, the time period within which a change in level of the home position signal is detected, is equivalent to one interval between successive printing position signals, that is, one energizing interval of the step motor. Such a time interval or step is usually equivalent only to approximately 1/60 of an inch (0.423 millimeters). At the same time, the power transmitting mechanism from the motor to the carriage always produces vibrations because of variations in the applied voltage, changes in frictional loads, variation in conditions for driving the carriage, such as rotational speed of the motor, and other reasons. Additionally, because the power transmitting mechanism includes a spring factor which causes vibrations, and because clearances exist, the step motor and the carriage are subject to vibrations which differ in mode or phase with each other. As a result, the level of the home position signal may change at a time not within the predetermined period between particular printing position signals or within a predetermined energizing interval of the motor. Thereby, the position for start of printing is not uniformly detected by the control circuit. Thus, the printer begins printing at non-uniform positions. Further, as printers are operated at higher velocities or higher resolution characters are printed, these difficulties increase.

What is needed is a control system for a serial printer which insures a uniform starting position for printing on each line even at high speed operation and with normal vibrations occuring in operation.

SUMMARY OF THE INVENTION

Generally speaking, in accordance with the invention, a serial printer especially suitable for uniform initiation of line printing is provided. The serial printer includes a control circuit for driving a step motor which translates the printer carriage. The control circuit detects the change of level of a home position signal in synchronism with a printing position signal. Then an output is produced to initiate printing based upon occurrence of particular data selected out of a cycle of data for driving the step motor. This control circuit increases the permissible range of variations in the change of level of the home position signal which can occur due to mechanical vibrations which differ in mode or phase. In other words, a particular time relationship is required between a print signal, home position signal, and motor phase driving signal in order to initiate the start of printing for a line. Further, the validity of the home position signal is confirmed by means of a flip-flop circuit which is clocked by the print position signal. Thus variations in the change of level of the home position signal do not affect the starting position for printing of a line. The time interval in which a change of level of the home position signal is sensed for detecting the position for starting printing is extended to one complete sequence, that is, several intervals for energization of the motor as compared to a time interval in the prior art between printing position signals or during one energizing interval of the motor.

Accordingly, it is an object of the invention to provide an improved serial printer control which allows uniform initiation of printing on each line.

Another object of this invention is to provide an improved serial printer which provides uniform printing initiation on each line regardless of mechanical vibrations in the structure.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which;

FIG. 2 is a perspective view of a printing position signal detector;

FIG. 3 is a fragmentary perspective view of a home position signal detector;

FIG. 4 is a circuit diagram showing a control circuit and connection of the detectors of FIGS. 2, 3;

FIG. 5 is a timing chart showing the phase relationship among the signals generated by the circuit of FIG. 4, and an energization sequence for a step motor;

DESCRIPTION OF THE PREFERRED EMBODIMENTS

Figure 1:
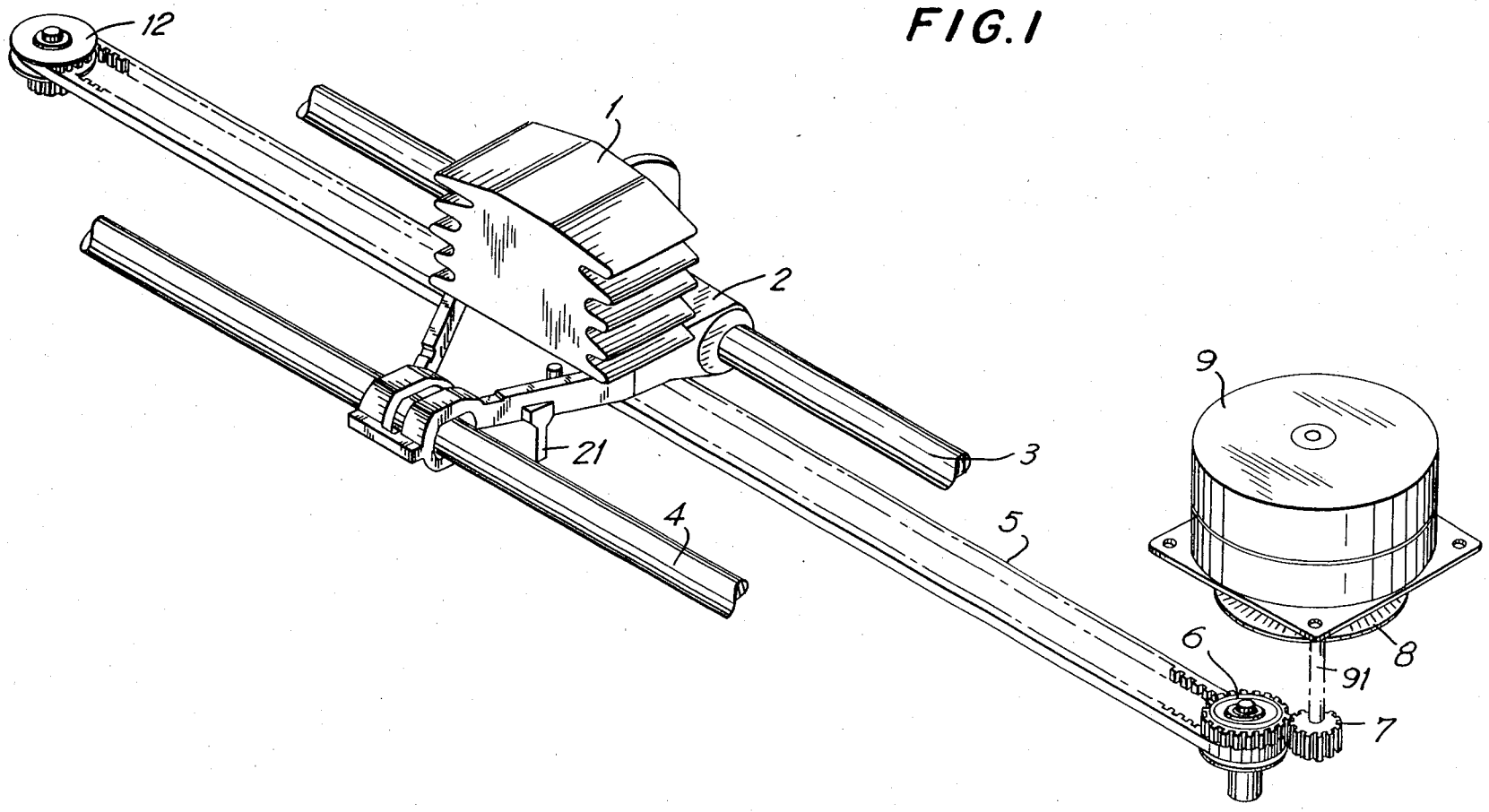
FIG. 1 is a schematic perspective view of a carriage driving mechanism for a serial printer in accordance with the invention.

Referring to FIGS. 1–3, components of a control system in accordance with the present invention, that is, a carriage driving mechanism and apparatuses for producing a printing position signal (PS) and a home position signal (HS), respectively, are shown schematically. The system has a four-phase, N pole step motor 9 including a rotor shaft 91, to which a pinion 7 is fixedly secured.

Also, firmly secured to the shaft 91 is a disk 8 having N slots 81. A printing position signal detector 10 comprising a photo-interrupter is positioned so as to detect the slots 81. A toothed wheel 6 engages the pinion 7, and a pulley is joined to the wheel for driving a belt 5 so that rotation of the motor 9 is transmitted to a carriage 2 via the belt 5.

A printing head 1 is carried on the carriage 2, and a flag 21 protrudes from the underside of the carriage 2 to interrupt the optical axis of a home position signal detector 11 comprising a photo-interrupter. The carriage 2 is slidably mounted on guide shafts 3, 4 so that it moves in the lateral direction in which characters are printed. A pulley 12 is driven by the belt. The manner in which the detectors 10, 11 and a control circuit are connected is illustrated in FIG. 4.

In operation of the serial printer, each time the printing position signal detector 10 detects one slot 81 formed in the disk 8, a high level printing position signal appears at its output terminal. Further, whenever the step motor 9 rotates through an angle equivalent to one pole of the motor, that is 1/N rotation, one high level printing position signal is produced. In this embodiment, assume that every time the motor makes a 1/N turn, the carriage is moved one-sixtieth of an inch (0.423 mm) in the aforementioned lateral direction. Particularly when the printer is a dot-matrix printer, if the printing position signal is used for timely driving of wires or other means to make dots, then excellent character-forming dots can be obtained.

The home position signal detector 11 produces a reference or home position signal so that the position of the carriage 2 in the lateral direction can be detected. When the carriage 2 is in the home position as shown in FIG. 3, the flag 21 acts to interrupt the optical axis in the detector 11, and when the flag 21 moves away from the home position, the home position signal (HS) appearing at output terminal Y (FIG. 4) changes from low level to high level. The movement of the carriage 2 in the lateral direction is controlled by a motor controller circuit (FIG. 6) using the change in level of the home position signal as a reference at all times. A home position signal-change confirmation signal (AS) is synthesized by a D type flip-flop having the printing position signal and the home position signal as inputs for avoiding the influence of variation in the change of level of the home position signal.

The phase relations among the printing position signal (PS), home position signal (HS), home position signal-change confirmation signal (AS) and the energization sequence of the step motor are illustrated in FIG. 5, in which phases A through D indicate the signals on the energizing coils of a four-phase motor. Further, in FIG. 5, designated at $\phi$1 through $\phi$4 are data signals which a CPU in the motor controller circuit outputs to a drive circuit for driving the step motor in a known manner, and the period in which the motor is energized with the respective data signals is defined as an energizing interval. When the motor is energized in two-two phase mode, 4 cycles having energizing intervals $\phi$1 through $\phi$4 are repeated. By having the period for detecting a change in level of the home position signal by the control circuit equal to four cycles of energizing interval, the permissible range of variation in the change of level of the home position signal can be extended to four cycles of the printing position signal, which is equivalent to 4/60 inch (about 1.7 mm) movement of the carriage. Heretofore, it has been desired that the amount of linear variation in the change of the HS level be kept within 1/60 inch, thus necessarily making the carriage driving mechanism complicated and increasing the manufacturing cost. On the other hand, the length of 4/60 inch will not introduce great difficulties in making a serial printer.

Figure 6:
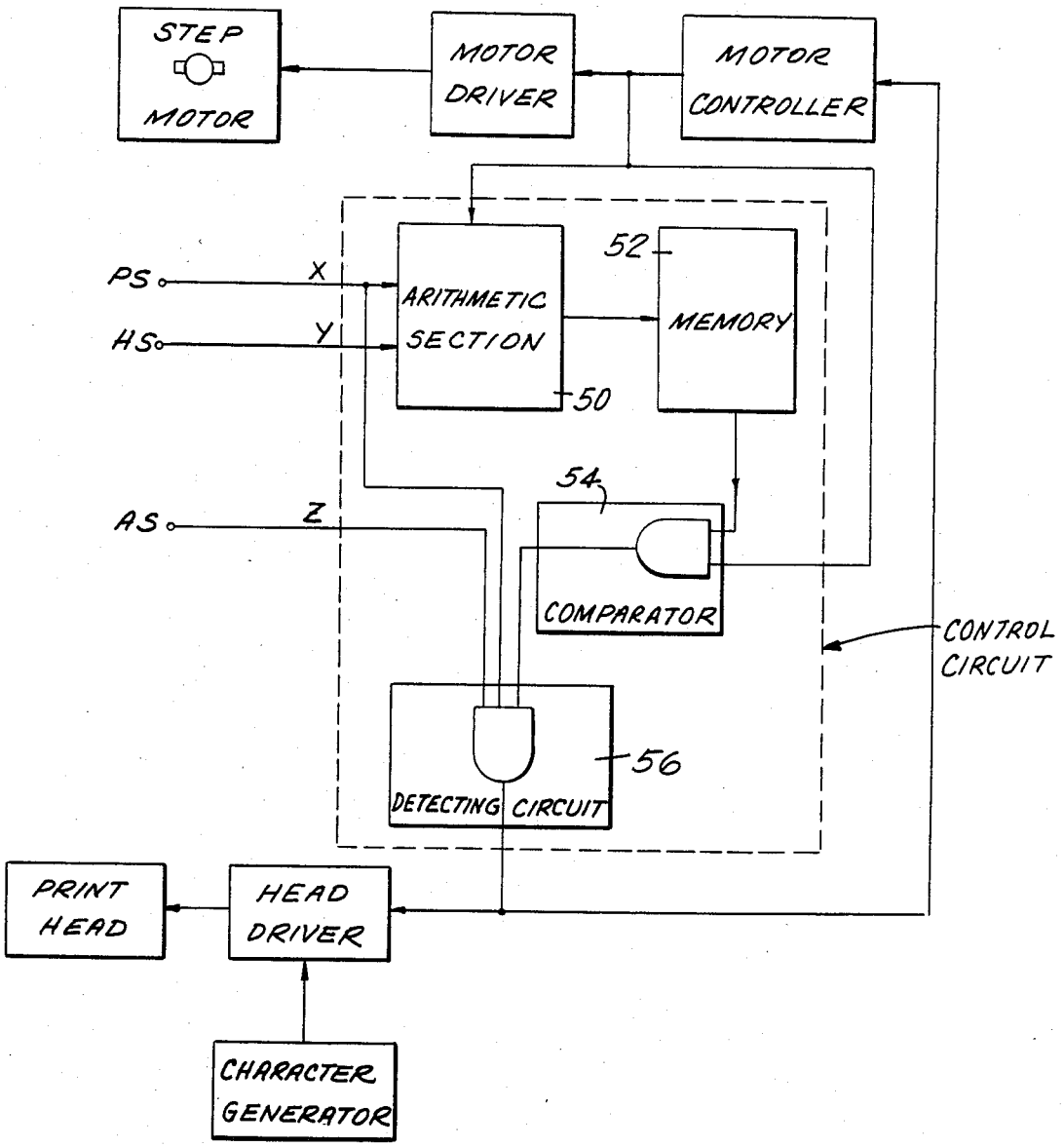
FIG. 6 is a functional diagram of a serial printer with details of the control circuit of FIG. 4.

FIG. 6 provides details of the control circuit of FIG. 4 and the printer. The control circuit, including an arithmetic section 50, memory 52, comparator 54, and detecting circuit 56, has inputs PS, HS, AS as illustrated in FIG. 4. Home position-seek is the initial operation when the power supply is turned on for moving the carriage to the home position prior to printing. The arithmetic section 50 reads an indication of the instant energization data for energizing the step motor at the time when the level of the home position signal HS changes during the home-position seek operation of the carriage. The arithmetic section 50 then adds an integer to the identification of the energization data and inputs the resultant data into the memory 52.

As stated, the memory 52 stores the energization data supplied from the arithmetic section 50, and outputs this data to the comparator 54 which compares the energization data supplied from the memory 52 with instantaneous data used in actual driving of the step motor. When these two inputs are identical, that is, when the motor is being driven in a phase which is that integer number (from the arithmetic section 50) of phases following the phase wherein the home position signal is detected, the comparator 54 outputs an identification signal to the detecting circuit 56. The data used for actual driving of the step motor is stored in the motor controller outside of the control circuit. The motor controller supplies previously stored energization data identified as $\phi$1 to $\phi$4 in sequence (FIG. 5) to the motor driver for driving the step motor.

Upon input of the identification signal from the comparator 54, the detecting circuit 56 outputs a high signal in response to this identification signal being concurrent with the home position signal HS, the confirming signal AS, and in synchronism with the leading edge of the printing position signal PS. Thus, a printing start position is provided as the output of the detecting circuit 56. The print head is driven at the next printing position (PS) following output of the printing start position signal from the detecting circuit 56.

In other words, when the power supply (not shown) of the printer is turned on, the control circuit effects a home position seek operation for moving the carriage to a home position prior to printing. In this operation the carriage moves in steps until generating a change of level HS of the home position signal. At the time of the change in level of the home position signal, energization data used for energizing the step motor is read out and an integer, for example 2, is added to this data by the arithmetic section 50. The resultant data is then stored in the memory 52. Assume for example, that during the home position-seek operation, the level of the home position signal changes and at this moment the step motor is energized using energization data $\phi$4 (FIG. 5). The data of $\phi$4 plus the integer 2 indicates $\phi$2 in that there are only four phases in the driving cycle. Thus data of $\phi$2 is stored in the memory. As is apparent from FIG. 5, the data $\phi$2 is the most separated in time from the data $\phi$4 in this example. Thus, detection of the level change of the home position signal HS is determined in the phase position most separated from the actual position where the level of the home position signal HS actually changes. During the ongoing printing operation, in this example, the control circuit determines the print start position only when the step motor is energized with the data $\phi$2 and at the same time the home position confirmation signal AS is high, and the signal PS goes high.

In the illustrated embodiment, the detection of the change of level of the home position signal is performed in synchronism with the leading edge of the print position signal generated while the motor is being driven in accordance with the energization data for the interval $\phi 1$. That is, the home position confirmation signal is produced in the energization interval $\phi 1$. Thus, if a print start signal is to be produced in the energization interval $\phi 2$ in synchronism with the print position signal $T_{n+1}$ occurring within that interval, the change in level of the home position signal may occur at any time between the leading edge of print position signal $T_{n-3}$ and the leading edge of print position signal $T_{n+1}$. Accordingly, variations in the detection of the home position of the printing head within one cycle of the four energizing intervals can be tolerated without affecting the timing of the production of a print start signal.

Construction of the control circuit can be attained by general-purpose registers, read-only memories, random access memories, latch circuits, buffer circuits, similar means or combinations thereof in a microcomputer system without increasing the manufacturing cost very much as compared with conventional control circuits.

Although the aforementioned embodiment uses a four-phase motor for driving the carriage, any other motor having three or more phases can be used to equal effect. Further, energization of the motor is not limited to a two-two phase mode as described above. For example, one-phase mode energization and one-two phase mode energization may be used.

As described above a serial printer using a step motor for driving a carriage and employing a control system in accordance with the present invention is unaffected by vibrations which differ in mode or phase from each other and are produced between the motor and the carriage. Hence, printing start positions are made uniform and, accordingly, regular and beautiful characters are printed.

What is claimed is:

1. A control system of a serial printer, said system comprising:

an N pole step motor having energizing coils whose number of phases is equal to or greater than three;

first detection means, said first detection means producing N signals indicative of print positions;

a carriage carrying a printing head thereon, said carriage being driven by said step motor so as to move in the direction that characters are printed;

second detection means for detecting the position of said carriage to produce a home position signal; and control means for sensing particular energization data of a cycle of energization data used for driving said step motor, the print position signal produced while said step motor is energized in accordance with said particular energization data and a change of level of the home position signal, simultaneous occurrence of said particular data and said print and home position signals enabling said printer for printing, said cycle of energization data having a number of intervals, the number of intervals corresponding to the phases of said energizing coils, and said control means being configured so that sensing of the change in level of the home position signal occurs in an interval most removed in time during said cycle from an interval in which the change in level of the home position signal actually occurs.

2. A control system as claimed in claim 1 which the second detector is disposed at a position separate and apart from the first detector, the second detector being disposed along a path of said carriage.

3. The control system as claimed in claim 1 in which the control means comprises:

delay means having an input for receiving said print position signals and an input for receiving said home position signal, said delay means producing a confirming home position signal output when the home position signal is followed in time by one of said print position signals during occurrence of first particular energization data; and detecting means for detecting a coincidence between another one of said print position signals, said confirming home position signal and other of said particular energization data, said detecting means producing an output for enabling printing when said coincidence occurs.

4. A control system as claimed in claim 1, and further comprising delay means, a confirming home position signal being output from said delay means after a delay, said delay means comprising a flip flop circuit being input said home position signal and being clocked by said print position signal, said confirming signal being output in synchronism with the first print position signal following said home position signal.

5. A control system as claimed in claim 4, and further comprising arithmetic means, said arithmetic means receiving said print position signals and said home position signal, said arithmetic means sensing an indication of said particular energization data energizing said step motor at the time of said home position signal and adding an integer thereto, said integer representing phase intervals in said cycle of energization data;

memory means for storing the sum of said particular energization data and said integer;

comparator means for comparing said sum in said memory means with the instantaneous energization data of said motor, equality of said signals input to said comparator producing an output from said comparator;

a detecting circuit, said detecting circuit being input the print position signals, confirming home position signal and the output of said comparator, said detecting circuit providing an output when said three inputs are concurrently received, the output of said detecting circuit enabling said printer to commence printing, said integer value in said sum providing a controlled time gap between occurrence of said home position signal and initiation of printing.

6. A control system as claimed in claim 1, wherein said first detection means is secured to the rotor shaft of said step motor.

7. A control system of a serial printer, the system comprising:

an N pole step motor having energizing coils whose number of phases is equal to or greater than three;

a disk fixedly secured to the rotor shaft of said motor and provided with N slots;

a first detector for detecting the slots to produce a signal indicative of print positions;

a carriage driven by said motor so as to move a printing head mounted thereon;

a second detector for detecting the position of the carriage to produce a home position signal, and a control circuit receiving both the signal indicative of print position and said home position signal, said control circuit detecting the change of level of said home position signal in synchronism with a print position signal, said print position signal being produced while the motor is energized in accordance with particular energization data selected out of a cycle of energization data for driving the motor, simultaneous occurrence of said particular data and said print and home position signals enabling said printer for printing, said cycle of energization data having a number of intervals, the number of intervals corresponding to the phases of said energizing coils, and said control circuit being configured so that detection of change in level of the home position signal occurs in an interval most removed in time from an interval in which the change in level of the home position signal actually occurs.

8. A control system as claimed in claim 7, and further comprising delay means, a confirming home position signal being output from said delay means by said control circuit after a delay.

9. A control system as claimed in claim 8, wherein said delay means comprises a flip-flop circuit being input said home position signal and being clocked by said print position signal, said confirming signal being output by the first print position signal following said home position signal.

10. A control system as claimed in claim 7 which the second detector is disposed at a position separate and apart from the first detector, the second detector being disposed along a path of said carriage.

11. The control system as claimed in claim 7 in which the control circuit comprises:

delay means having an input for receiving said print position signals and an input for receiving said home position signal, said delay means producing a confirming home position signal output when the home position signal is followed in time by one of said print position signals during occurrence of first particular energization data; and detecting means for detecting a coincidence between another one of said print position signals, said confirming home position signal and other of said particular energization data, said detecting means producing an output for enabling printing when said coincidence occurs.

12. A control system of a serial printer, said system comprising:

a step motor for driving a printing head across a recording medium and arranged to operate in a cycle of three or more energization data;

first detection means for detecting the position of said step motor after each step thereof and for producing a print position signal indicative of the position of said printing head;

second detection means for producing a home position signal when said printing head is detected in a home position; and control means for determining a predetermined energization data of said step motor in which a print start signal is to be produced, and for producing a print start signal during the first occurrence of the predetermined energization data, in synchronism with a print position signal, after the production of a home position signal, said step motor having energizing coils having a plurality of phases, said predetermined energization data being data in a cycle of energization data having a number of intervals, the number of intervals corresponding to the phases of said energizing coils, and said control means being configured to respond to the home position signal in an interval most removed in time from an interval in which a change in level of the home position signal occurs.

13. A control system as claimed in claim 12 which the second detector is disposed at a position separate and apart from the first detector, the second detector being disposed along a path of said carriage.

14. The control system as claimed in claim 12 in which the control means comprises:

delay means having an input for receiving said print position signals and an input for receiving said home position signal, said delay means producing a confirming home position signal output when the home position signal is followed in time by one of said print position signals during occurence of first particular energization data; and detecting means for detecting a coincidence between another one of said print position signals, said confirming home position signal, and other of said particular energization data, said detecting means producing an output for enabling printing when said coincidence occurs.

15. A control system of a serial printer, said system comprising:

a step motor for driving a printing head across a recording medium and arranged to operate in a cycle of three or more energization data;

first detection means for detecting the position of said step motor after each step thereof and for producing a print position signal indicative of the position of said printing head;

second detection means for producing a home position signal when said printing head is detected in a home position; and control means for determining a predetermined energization data of said step motor in which a print start signal is to be produced, and for producing a print start signal during the first occurrence of the predetermined energization data, in synchronism with a print position signal, after the production of a home position signal, the predetermined energization data being data in said cycle of energization data, and said control means including means for responding to said home position signal at a time in said cycle when data different than said predetermined data are being used to drive said step motor.

16. A control system of a serial printer, said system comprising:

an N pole step motor having energizing coils whose number of phases is equal to or greater than three;

first detection means, said first detection means producing N signals indicative of print positions;

a carriage carrying a printing head thereon, said carriage being driven by said step motor so as to move in the direction that characters are printed;

second detection means for detecting the position of said carriage to produce a home position signal; and control means for sensing particular energization data of a cycle of energization data used for driving said step motor, the print position signal produced while said step motor is energized in accordance with said particular energization data and a change of level of the home position signal, simultaneous occurrence of said particular data and said print and home position signals enabling said printer for printing, said control means including:

delay means having an input for receiving said print position signals and an input for receiving said home position signal, said delay means producing a confirming home position signal output when the home position signal is followed in time by one of said print position signals during occurrence of first particular energization data; and detecting means for detecting a coincidence between another one of said print position signals, said confirming home position signal and other of said particular energization data, said detecting means producing an output for enabling printing when said coincidence occurs.

17. A control system of a serial printer, the system comprising:

an N pole step motor having energizing coils whose number of phases is equal to or greater than three;

a disk fixedly secured to the rotor shaft of said motor and provided with N slots;

a first detector for detecting the slots to produce a signal indicative of print positions;

a carriage driven by said motor so as to move a printing head mounted thereon;

a second detector for detecting the position of the carriage to produce a home position signal, and a control circuit receiving both the signal indicative of a print position and said home position signal, said control circuit detecting the change of level of said home position signal in synchronism with a print position signal, said print position signal being produced while the motor is energized in accordance with particular energization data selected out of a cycle of energization data for driving the motor, simultaneous occurrence of said particular data and said print and home position signals enabling said printer for printing, said control circuit including:

delay means having an input for receiving said print position signals and an input for receiving said home position signal, said delay means producing a confirming home position signal output when the home position signal is followed in time by one of said print position signals during occurrence of first particular energization data; and detecting means for detecting a coincidence between another one of said print position signals, said confirming home position signal and other of said particular energization data, said detecting means producing an output for enabling printing when said coincidence occurs.

18. A control system of a serial printer, said system comprising:

a step motor for driving a printing head across a recording medium and arranged to operate in a cycle of three or more energization data;

first detection means for detecting the position of said step motor after each step thereof and for producing a print position signal indicative of the position of said printing head;

second detection means for producing a home position signal when said printing head is detected in a home position; and control means for determining a predetermined energization data of said step motor in which a print start signal is to be produced, and for producing a print start signal during the first occurrence of the predetermined energization data, in synchronism with a print position signal, after the production of a home position signal, said control means including:

delay means having an input for receiving said print position signals and an input for receiving said home position signal, said delay means producing a confirming home position signal output when the home position signal is followed in time by one of said print position signals during occurrence of first particular energization data; and detecting means for detecting a coincidence between another one of said print position signals, said confirming home position signal, and other of said particular energization data, said detecting means producing an output for enabling printing when said coincidence occurs.

* * * * *